US008150684B2

(12) United States Patent
Kawashima et al.

(10) Patent No.: US 8,150,684 B2
(45) Date of Patent: Apr. 3, 2012

(54) SCALABLE DECODER PREVENTING SIGNAL DEGRADATION AND LOST DATA INTERPOLATION METHOD

(75) Inventors: Takuya Kawashima, Ishikawa (JP); Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1130 days.

(21) Appl. No.: 11/994,140

(22) PCT Filed: Jun. 27, 2006

(86) PCT No.: PCT/JP2006/312779

§ 371 (c)(1),
(2), (4) Date: Dec. 28, 2007

(87) PCT Pub. No.: WO2007/000988

PCT Pub. Date: Jan. 4, 2007

(65) Prior Publication Data

US 2009/0141790 A1 Jun. 4, 2009

(30) Foreign Application Priority Data

Jun. 29, 2005 (JP) ..... 2005-189532

(51) Int. Cl.
*G10L 19/00* (2006.01)

(52) U.S. Cl. ..... 704/219

(58) Field of Classification Search ..... 704/201, 704/219, 501

See application file for complete search history.

(56) References Cited

U.S. PATENT DOCUMENTS 5,894,473 A * 4/1999 Dent ..... 370/342
6,252,915 B1 * 6/2001 Mollenkopf et al. ..... 375/297
6,445,696 B1 * 9/2002 Foodeei et al. ..... 370/356
7,286,982 B2 * 10/2007 Gersho et al. ..... 704/223
7,315,815 B1 * 1/2008 Gersho et al. ..... 704/223
7,502,375 B2 * 3/2009 Hahn et al. ..... 370/401

(Continued)

FOREIGN PATENT DOCUMENTS

EP 1199709 A 4/2002

(Continued)

OTHER PUBLICATIONS

"Digital cellular telecommunications system (Phase 2+); Universal Mobile Telecommunications System (UMTS); AMR speech codec, wideband; Error concealment of lost frames (3GPP TS 26.191 version 6.0.0 Release 6); ETSI TS 126 191," ETSI Stamdards, LIS, Sophia Antipolis Cedex, France, vol. 3-SA4, No. V6.0.0, Dec. 1, 2004, XP014027745.

(Continued)

*Primary Examiner* — Michael N Opsasnick
(74) *Attorney, Agent, or Firm* — Greenblum & Bernstein, P.L.C.

(57) ABSTRACT

A scalable decoder capable of preventing degradation of the quality of the decoded signal in a disappeared data interpolation in band scalable coding. A core layer decoding section (101) acquires a core layer decoded signal and narrow band spectrum information by decoding. A narrow band spectrum slope computing section (103) computes the slope of an attenuation line of a narrow band spectrum from the narrow band spectrum information. An extended layer disappearance detection section (104) detects whether extended layer coded data has disappeared or not. An extended layer decoding section (105) normally decodes the extended layer coded data. If the extended layer disappears, a parameter required for decoding is interpolated and synthesizes an interpolation decoded signal by the interpolated parameter. The gain of the interpolated data is controlled according to the results of the computation, by the narrow band spectrum slope computing section (103).

10 Claims, 9 Drawing Sheets

U.S. PATENT DOCUMENTS

| | | | | |
|---|---|---|---|---|
| 7,610,198 | B2 * | 10/2009 | Thyssen | 704/230 |
| 7,617,096 | B2 * | 11/2009 | Thyssen | 704/219 |
| 2002/0072901 | A1 * | 6/2002 | Bruhn | 704/229 |
| 2002/0097807 | A1 | 7/2002 | Gerrits | |
| 2003/0078773 | A1 * | 4/2003 | Thyssen | 704/230 |
| 2003/0078774 | A1 * | 4/2003 | Thyssen | 704/230 |
| 2003/0083865 | A1 * | 5/2003 | Thyssen | 704/205 |
| 2005/0228651 | A1 * | 10/2005 | Wang et al. | 704/207 |
| 2007/0100613 | A1 | 5/2007 | Yasunaga et al. | |
| 2007/0255558 | A1 | 11/2007 | Yasunaga et al. | |
| 2007/0271092 | A1 | 11/2007 | Ehara et al. | |

FOREIGN PATENT DOCUMENTS

| | | |
|---|---|---|
| JP | 6-125361 | 5/1994 |
| JP | 2000-352999 | 12/2000 |
| JP | 2003-241799 | 8/2003 |
| JP | 2004-518346 | 6/2004 |
| WO | 02/058052 | 7/2002 |

OTHER PUBLICATIONS

Bessette et al., "The Adaptive Multirate Wideband Speech Codec (AMR-WB)," IEEE Transactions on Speech and Audio Processing, IEEE Service Center, New York, NY, US, vol. 10, No. 8, Nov. 1, 2002, XP011079675.

Japanese language translation of JP 2003-241799, 2003.

Japanese language translation of JP 6-125361, 1994.

Japanese language translation of JP 2000-352999, 2000.

"Adaptive Multi-Rate (AMR) Speech Codec; Error Concealment of lost frames", 3GPPTS26.091v.5.0.0 (Jun. 2002), pp. 1-13.

U.S. Appl. No. 11/908,513, Kawashima et al., filed Sep. 13, 2007.

* cited by examiner

SCALABLE DECODER PREVENTING SIGNAL DEGRADATION AND LOST DATA INTERPOLATION METHOD

TECHNICAL FIELD

The present invention relates to a scalable decoding apparatus and lost data interpolation method.

BACKGROUND ART

Scalable coding refers to hierarchically encoding a speech signal and includes features that the speech signal can be decoded from encoded data of the other layer even if encoded data (coding information) of a given class (layer) is lost. Scalable coding of hierarchically encoding a narrowband speech signal and wideband speech signal is referred to as "band scalable speech coding."

Generally, in scalable speech coding, a narrowband signal is encoded in the most basic layer and wideband signals of one layer below or above are encoded as a target in proportion to an increase of layers. Then, in this description, the most basic coding/decoding processing layer is referred to as a "core layer" and a coding/decoding processing layer realizing higher quality and wider band compared to the core layer is referred to as an "enhancement layer."

Moreover, speech codec used in scalable coding includes features that a part of encoded data of a layer can be decoded even if the data is lost, and is suitable for encoding for VoIP (Voice over IP) which exchanges a speech signal as data using a packet communication path such as an IP network.

However, in best effort type packet communication, a transmission band is not generally secured, a part of a packet is lost or delayed and a part of encoded data is likely to be defective. For example, when traffic of a communication path is saturated due to congestion, encoded data is lost on the transmission path due to packet discard. Due to such defect of encoded data, cases occur in a decoding apparatus where decoding cannot be carried out at all, only coding information of a core layer is received or information up to an enhancement layer is received. Furthermore, these cases occur one after another over time, and, for example, a case may occur where a frame receiving only coding information of the core layer and a frame receiving coding information up to the enhancement layer need to be alternately decoded by switching the frames periodically. In such a case, when layer switching occurs, the sound volume and the band spread become discontinuous and sound quality of a decoded signal is deteriorated.

For example, Non-Patent Document 1 discloses a technique of, upon frame lost, interpolating parameters required for combining a signal based on past information in frame loss interpolation processing by speech codec using single layer CELP. In this lost data interpolation technique, as for a gain in particular, a gain used for interpolation data is represented by using a monotonic decreasing function for a gain which is based on a normally received past frame. Further, in gain control from the time of frame loss to the time of encoded data reception, a decoded pitch gain is used as a pitch gain and a code gain having a smaller value is used as a code gain by comparing an interpolated code gain interpolated during loss period with a current decoded code gain.

Non-Patent Document 1: "AMR Speech Codec; Error Concealment of lost frames" TS26.091

DISCLOSURE OF INVENTION

Problems to be Solved by the Invention

A technique disclosed in Non-Patent Document 1 relates to a technique of interpolating lost data in typical CELP and basically decreases the interpolation gain based on past information alone during data loss period. When an interpolation period becomes longer, decoded interpolated speech becomes far from the originally decoded speech and this operation is necessary in order to prevent annoying sound.

However, when application of the technique disclosed in Non-Patent Document 1 to lost data interpolation processing of an enhancement layer of scalable speech codec is studied, interpolation data is likely to have a bad influence on quality of a normally decoded speech of the core layer and is likely to give listeners a sensation of annoying sound and a sensation of signal fluctuation in response to a condition of decoded speech power change of the core layer and the gain attenuation amount of the enhancement layer during the loss period of data of the enhancement layer. That is, when decoded speech power of the core layer substantially decreases upon enhancement layer loss and the interpolation gain of the enhancement layer moderately attenuates, quality of a decoded signal of the enhancement layer may deteriorate by carrying out interpolation. At this time, if the deteriorated decoded signal of the enhancement layer is highlighted, listeners perceive a sensation of annoying sound as a result. Further, when the attenuation amount of the interpolation gain of the enhancement layer increases in a condition where the decoded speech power of the core layer does not change, the decoded speech of the enhancement layer substantially decreases and the listeners perceive a sensation of signal fluctuation.

It is therefore an object of the present invention to provide a scalable decoding apparatus and a lost data interpolation method of preventing quality of a decoded signal from deteriorating and suppressing a sensation of annoying sound and a sensation of signal fluctuation for listeners in lost data interpolation processing in band scalable coding.

Means for Solving the Problem

The scalable decoding apparatus according to the present invention adopts a configuration including: a narrowband decoding section that decodes encoded data of a narrowband signal; a wideband decoding section that decodes encoded data of a wideband signal, and, when there is no encoded data, generates alternative interpolation data; a calculating section that calculates a condition of attenuation for a spectrum of the narrowband signal in the frequency domain based on the encoded data of the narrowband signal; and a controlling section that controls a gain of the interpolation data according to the condition of attenuation.

Advantageous Effect of the Invention

The present invention can prevent quality of a decoded signal from deteriorating and suppressing a sensation of annoying sound and a sensation of signal fluctuation for listeners in lost data interpolation processing in band scalable coding.

BEST MODE FOR CARRYING OUT THE INVENTION

The embodiment of the present invention will be described below in detail with reference to the accompanying drawings. Further, in this description, although a case will be described with a layer structure formed with two layers as an example, the present invention is not limited to the two layers.

Embodiment 1

Figure 1:
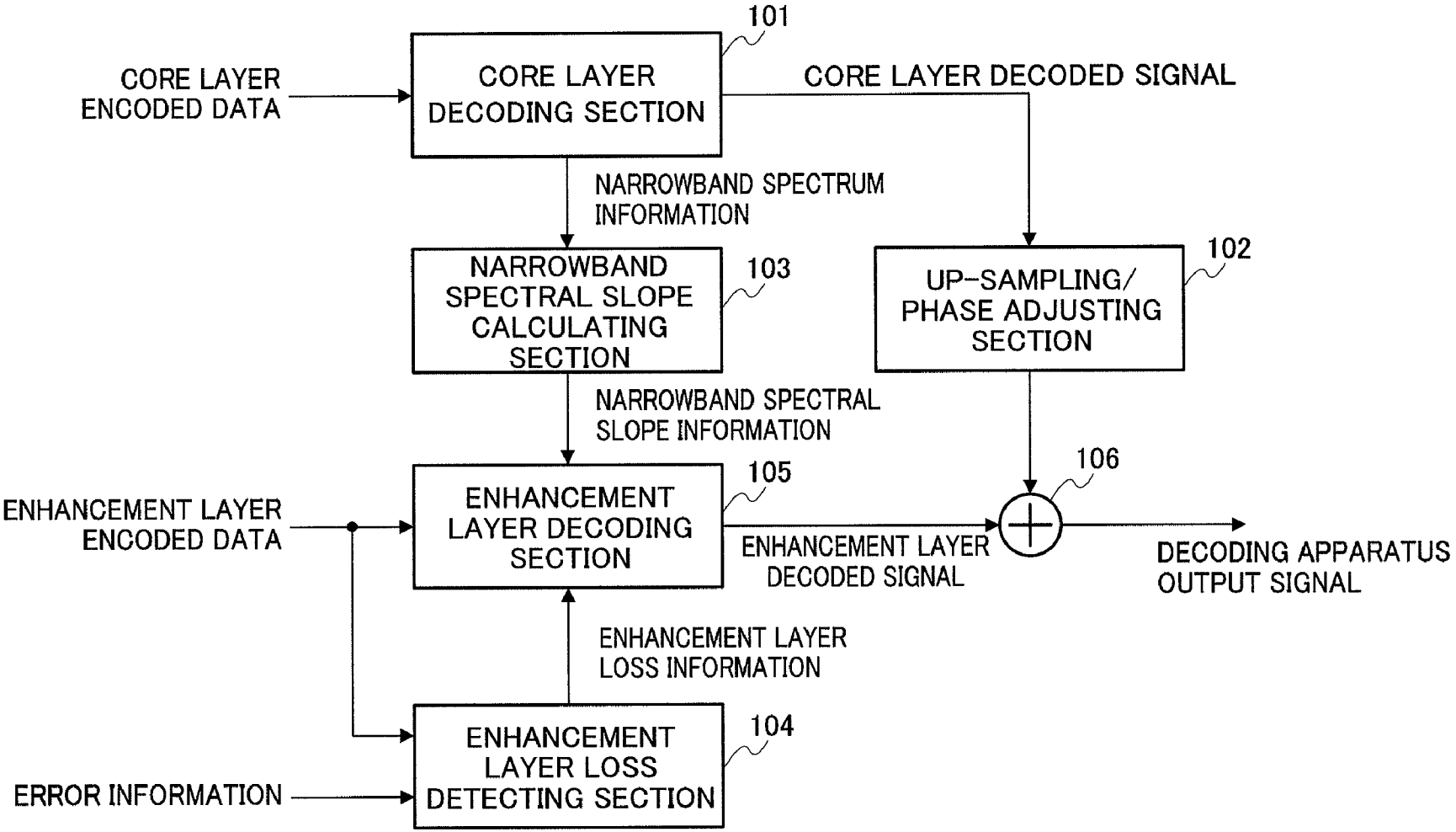
FIG. 1 is a block diagram showing a main configuration of the scalable decoding apparatus according to Embodiment 1.

FIG. 1 is a block diagram showing a main configuration of the scalable decoding apparatus according to Embodiment 1 of the present invention. A case will be described here as an example where a signal of a wider band in the enhancement layer than in the core layer is subjected to speech coding based on a CELP (Code Excited Linear Prediction) scheme.

The scalable decoding apparatus according to this embodiment has core layer decoding section 101, up-sampling/phase adjusting section 102, narrowband spectral slope calculating section 103, enhancement layer loss detecting section 104, enhancement layer decoding section 105 and decoded signal adding section 106 and decodes core layer encoded data and enhancement layer encoded data transmitted from an encoder (not shown).

Sections of the scalable decoding apparatus according to this embodiment carry out the following operations.

Core layer decoding section 101 decodes received core layer encoded data and outputs the obtained core layer decoded signal, which is a narrowband signal, to a core layer decoded signal analyzing section (not shown) and up-sampling/phase adjusting section 102. Further, core layer decoding section 101 outputs narrowband spectrum information (information relating to a narrowband spectral envelope and energy distribution) included in core layer encoded data, to narrowband spectral slope calculating section 103.

Up-sampling/phase adjusting section 102 carries out processing of adjusting (correcting) the difference in the sampling rate, delay and phase between the core layer decoded signal and the enhancement layer decoded signal. Here, the core layer decoded signal is converted according to the enhancement layer decoded signal. However, when the sampling rates and phases of the core layer decoded signal and the enhancement layer decoded signal are the same, there is no need for correcting the difference and the core layer decoded signal is multiplied by a constant as the need arises and is outputted. An output signal is outputted to decoded signal adding section 106.

Narrowband spectral slope calculating section 103 calculates the slope of the attenuation line of the narrowband spectrum in the frequency domain based on narrowband spectrum information outputted from core layer decoding section 101 and outputs this calculation result to enhancement layer decoding section 105. The calculated slope of the attenuation line of the narrowband spectrum is used to control the gain (enhancement layer interpolation gain) of interpolation data for lost data of the enhancement layer.

Enhancement layer loss detecting section 104 detects whether or not there is loss in enhancement layer encoded data, that is, whether or not enhancement layer encoded data can be decoded, based on error information transmitted independently of encoded data. The obtained frame error detection result from the enhancement layer (enhancement layer loss information) is outputted to enhancement layer decoding section 105. Further, a data loss detection method may check an error check code such as CRC added to encoded data, decide whether or not encoded data has not arrived by the time when decoding starts or detect that a packet is lost or has not arrived. Further, when critical errors are detected by the error check code included in enhancement layer encoded data in the process of decoding encoded data received in enhancement layer decoding section 105, enhancement layer decoding section 105 may input the error information to enhancement layer loss detecting section 104.

Typically, enhancement layer decoding section 105 decodes received enhancement layer encoded data and outputs the obtained enhancement layer decoded signal to decoded signal adding section 106. Further, when enhancement layer loss information (frame error) is reported from enhancement layer loss detecting section 104 (that is, when data of the enhancement layer is lost), enhancement layer decoding section 105 interpolates parameters required for decoding, synthesizes an interpolation decoded signal using the interpolation parameters and outputs the result to decoded signal adding section 106 as an enhancement layer decoded signal. Here, the gain of interpolation data is controlled according to the calculation result of narrowband spectral slope calculating section 103.

Decoded signal adding section 106 adds the core layer decoded signal outputted from up-sampling/phase adjusting section 102 and the enhancement layer decoded signal outputted from enhancement layer decoding section 105, and outputs the obtained decoded signal.

Figure 2:
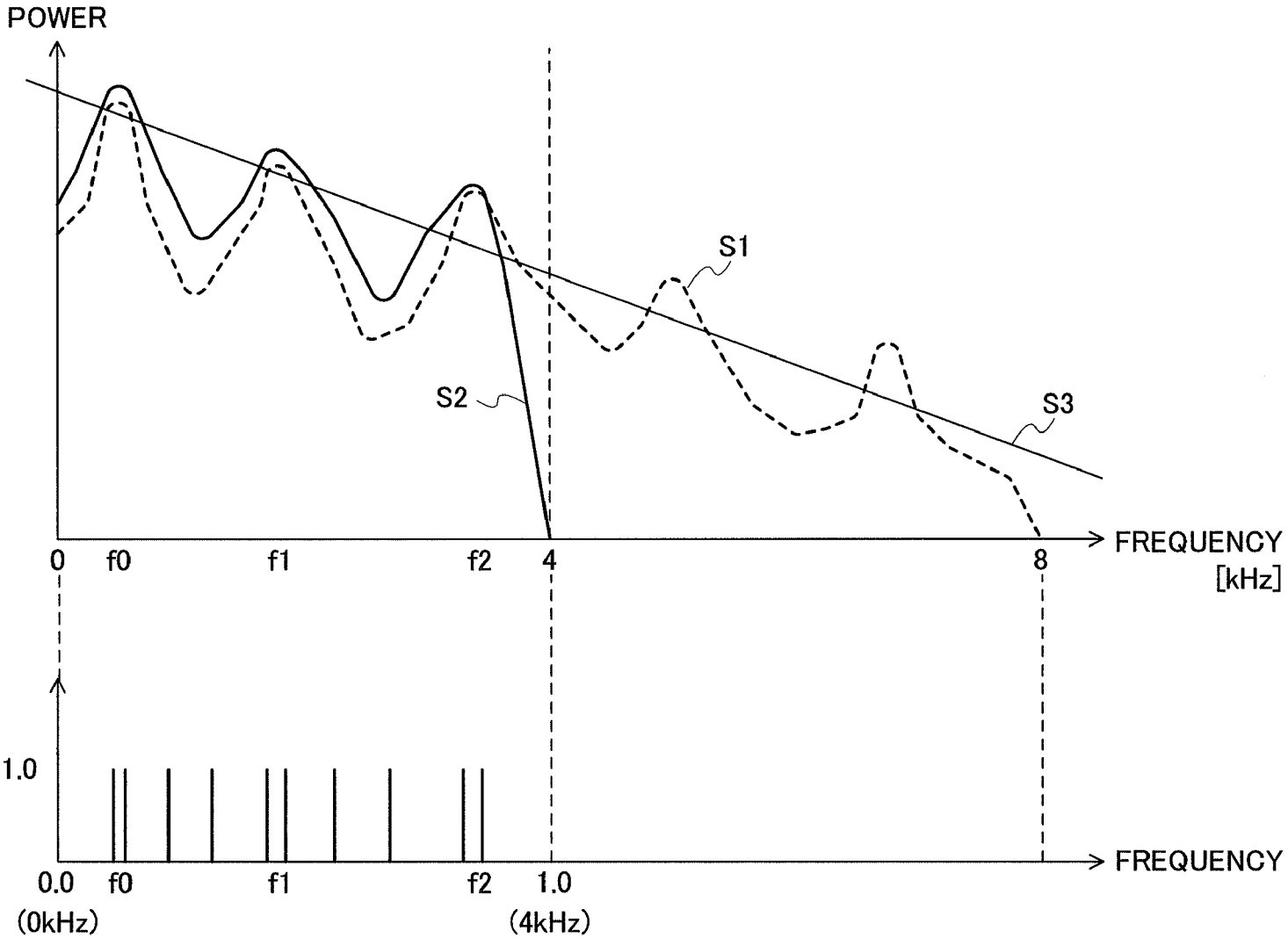
FIG. 2 illustrates calculating processing of a narrowband spectral slope.
Figure 3:
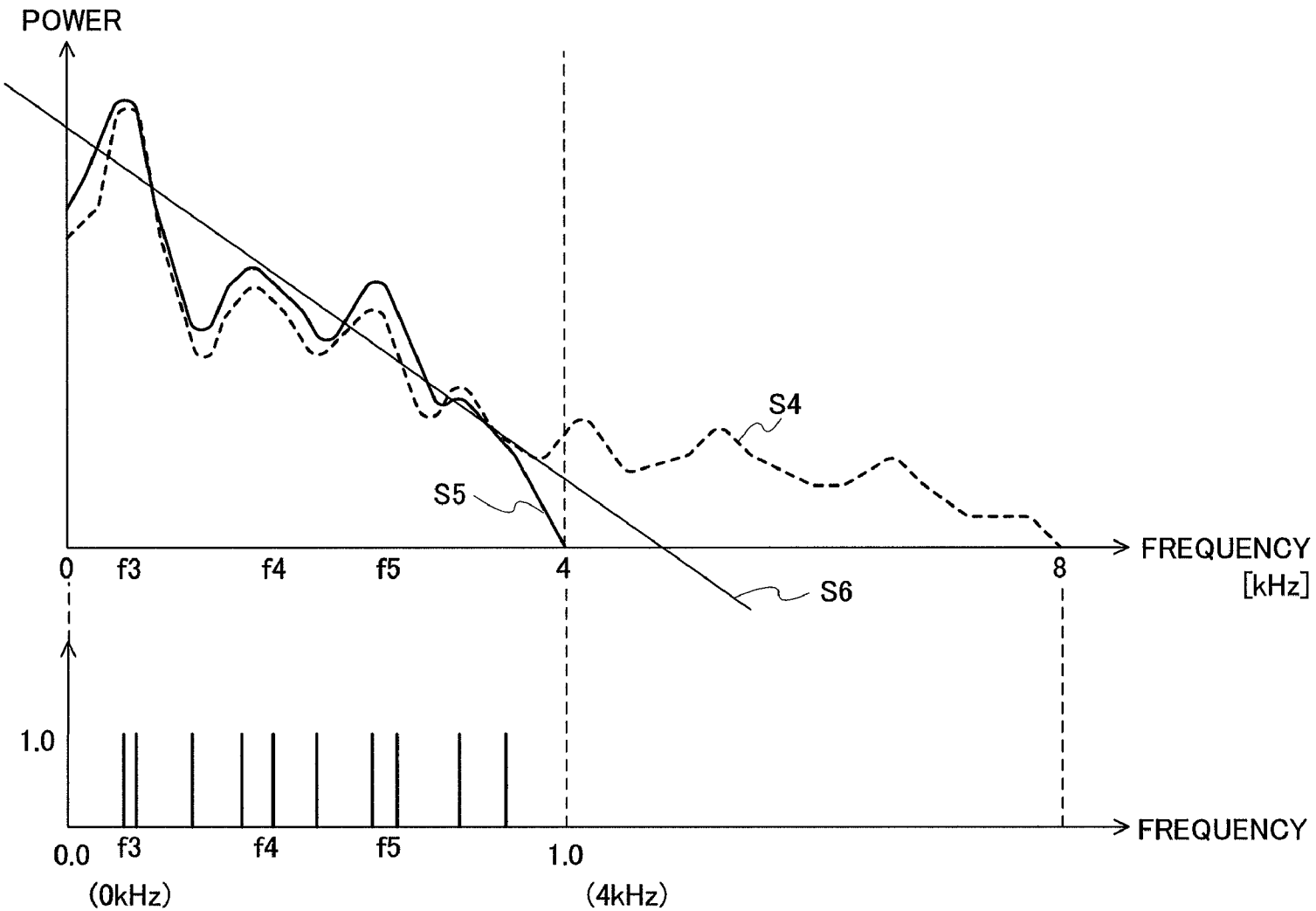
FIG. 3 illustrates calculating processing of a narrowband spectral slope.

FIG. 2 and FIG. 3 illustrate calculation processing of a narrowband spectral slope in narrowband spectral slope calculating section 103. Narrowband spectral slope calculating section 103 calculates the slope of the attenuation line of the narrowband spectrum approximately as follows using an LSP (Line Spectrum Pair) coefficient which is one type of linear predictive coefficients.

The spectra in the upper parts of FIG. 2 and FIG. 3 are examples of the narrowband spectrum and wideband spectrum. Cases will be described with these figures where the horizontal axis is the frequency and the vertical axis is power, and where a narrowband signal of 4 kHz or less is used as the core layer and a wideband signal of 8 kHz or less is used as the enhancement layer. In these figures, curves S1 and S4 shown by broken lines are the frequency envelopes of wideband signals and curves S2 and S5 shown by solid lines are frequency envelopes of narrowband signals. Generally, although a narrowband signal near the Nyquist frequency is separated from a wideband signal, frequency power distribution approximates in bands of the Nyquist frequency or less. Further, curves S3 and S6 shown by solid lines are attenuation lines of the narrowband spectrum in the frequency domain. This attenuation line is a characteristic curve showing the condition of attenuation for the narrowband spectrum and can be obtained by, for example, finding regression lines of sampling points.

The spectrum in the upper part of FIG. 2 shows a case where the slope of the attenuation line of the narrowband spectrum (hereinafter simply referred to as a "narrowband spectral slope") is moderate and the spectrum in the upper part of FIG. 3 shows a case where the slope of the narrowband spectrum is steep. Further, the signals in the lower parts of FIG. 2 and FIG. 3 are LSP coefficients (where analysis order M is order 10th) of the narrowband spectra shown in the upper parts of FIG. 2 and FIG. 3.

Generally, as for order components of LSP coefficients, adjacent order components are arranged mutually closer (order components of the LSP coefficients concentrate) in the part where the spectrum power concentrates as in a formant and are spaced apart from the adjacent order components in the part of the formant valley where energy is not concentrated. Here, the "adjacent orders of the LSP coefficients" refer to consecutive orders such as order i followed by order i+1.

Further, as shown in FIG. 2 and FIG. 3 as examples, order components of LSP coefficients are likely to concentrate near f0, f1, f2, f3, f4 and f5. Particularly, the distance between order components of the LSP coefficients is likely to become the shortest near the first formant where power concentrates at maximum. Furthermore, in the example of FIG. 2, there is a wideband signal up to a high band and a formant can be observed in the intermediate band. In this case, the distance between order components of the LSP coefficients near f1 and f2 becomes closer. On the other hand, in the example of FIG. 3, the intensity of a high band signal is weak in the wideband signal and the formant cannot be clearly observed in the intermediate band. In this case, the distance between order components of the LSP coefficients near f4 and f5 becomes greater compared to f1 and f2. As a result, to put it reversely, when the distance between order components of the LSP coefficients is small, higher energy is likely to exist near f4 and f5.

Based on the above LSP coefficient characteristics, narrowband spectral slope calculating section 103 finds the sum of the reciprocals of the square of the distances between adjacent order components of LSP coefficients as an index upon deciding whether power is great or small. Then, narrowband spectral slope calculating section 103 finds the dummy power of the whole narrowband (all order components of the narrowband LSP coefficient) and the dummy power of the high frequency band of the narrowband (hereinafter referred to as the "intermediate band"), and learns the dummy power ratio in the intermediate band with respect to the dummy power of the whole narrowband as a parameter representing the condition of attenuation for the spectrum. To be more specific, the calculated ratio corresponds to the slope of the narrowband spectrum and the narrowband spectrum substantially attenuates when this slope is steeper.

Figure 4:
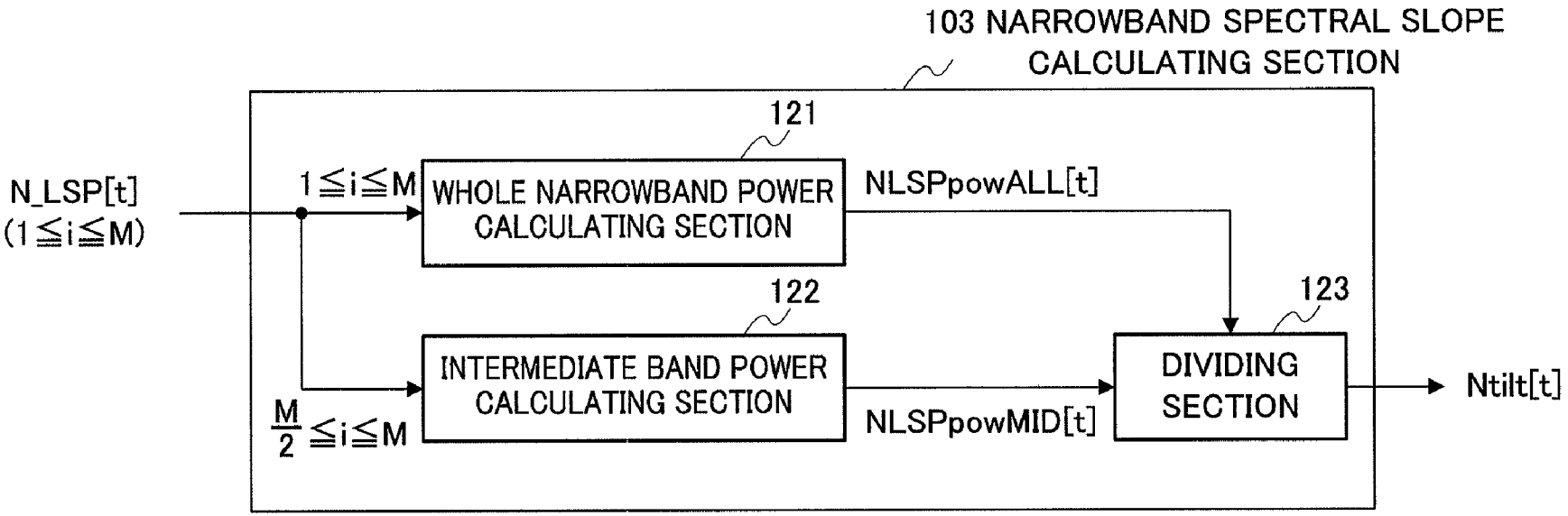
FIG. 4 is a block diagram showing a main internal configuration of a narrowband spectral slope calculating section according to Embodiment 1.

FIG. 4 is a block diagram showing a main internal configuration of narrowband spectral slope calculating section 103 realizing the above processing.

Narrowband spectral slope calculating section 103 has whole narrowband power calculating section 121, intermediate band power calculating section 122 and dividing section 123, receives as input an LSP coefficient of order M representing core layer spectral envelope information, calculates the narrowband spectral slope using the LSP coefficient and outputs the result.

Whole narrowband power calculating section 121 calculates the dummy power of the whole narrowband NLSPpowALL[t] based on following equation 1 from inputted narrowband LSP coefficient Nlsp[t].

[1]

$$NLSPpowALL[t] = \sum_{i=1}^{M-1} \frac{1}{(Nlsp[i+1] - Nlsp[i])^2} \quad \text{(Equation 1)}$$

Here, t is the frame number, M is the analysis order of the narrowband LSP coefficient and i is the order of the LSP coefficient ($1 \leqq i \leqq M$).

Intermediate band power calculating section 122 calculates the dummy power of the intermediate band using the narrowband LSP coefficient as input and outputs the result to dividing section 123. Here, the dummy power is calculated using coefficients of the high frequency band of the narrowband LSP coefficient alone, in order to calculate the dummy power of the intermediate band. Intermediate band power NLSPpowMID[t] is calculated based on following equation 2.

[2]

$$NLSPpowMID[t] = \sum_{i=M/2}^{M-1} \frac{1}{(Nlsp[i+1] - Nlsp[i])^2} \quad \text{(Equation 2)}$$

Dividing section 123 divides the intermediate band power by the whole narrowband power according to following equation 3 and calculates narrowband spectral slope Ntilt[t].

[3]

$$Ntilt[t] = \sqrt{\frac{NLSPpowMID[t]}{NLSPpowALL[t]}} \quad \text{(Equation 3)}$$

The calculated narrowband spectral slope is outputted to enhancement layer gain decoding section 112 described later.

In this way, it is possible to calculate the narrowband spectral slope by using the characteristics of the narrowband LSP coefficient.

Further, the position of the LSP coefficient changes according to the distribution of the narrowband spectrum, consequently the band of the intermediate band changes and so the accuracy of the narrowband spectral slope is likely to decrease. However, the decrease in the accuracy is little likely to have an influence on auditory quality of the attenuating rate of the interpolation gain of the enhancement layer.

Figure 5:
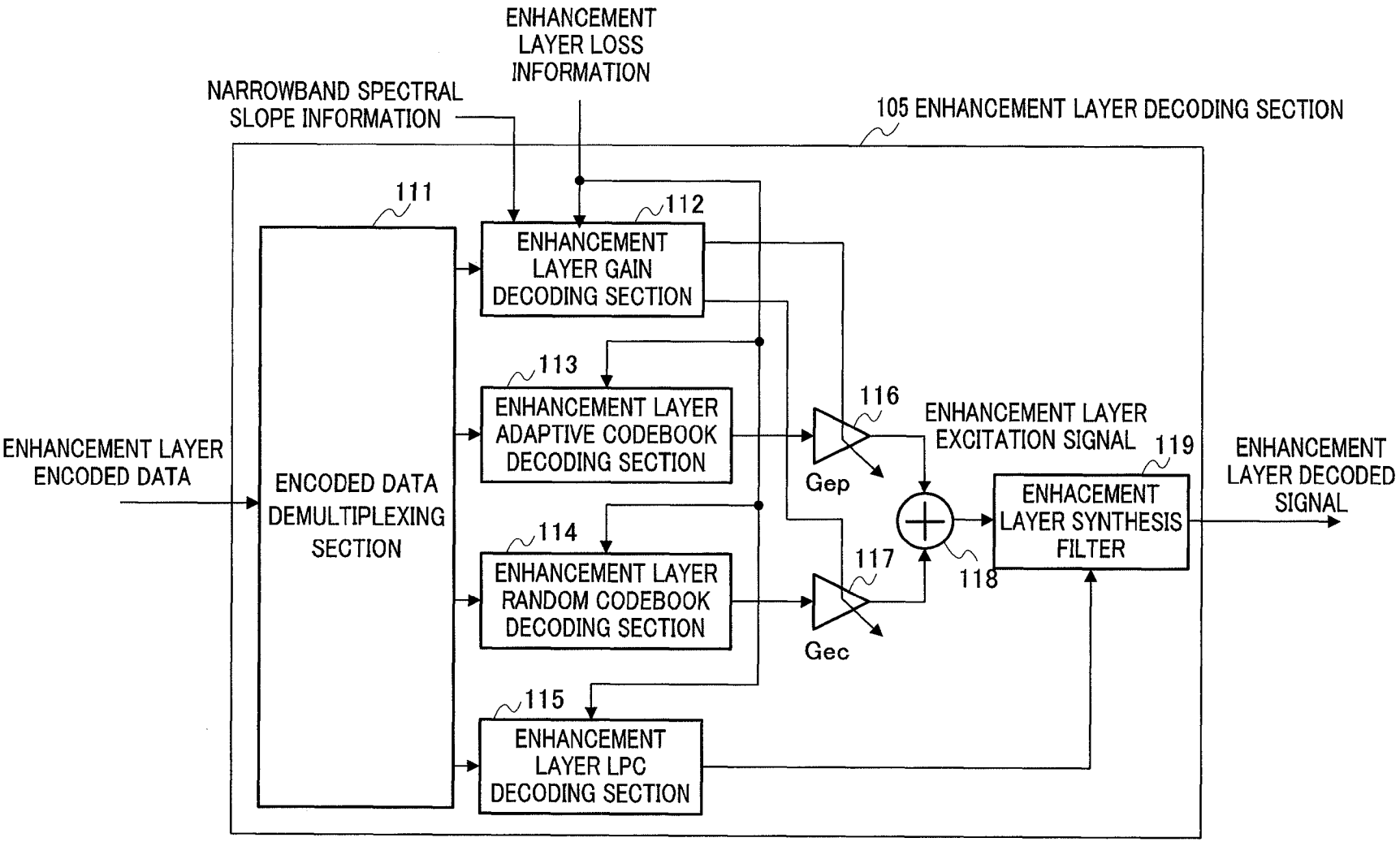
FIG. 5 is a block diagram showing a main internal configuration of an enhancement layer decoding section according to Embodiment 1.

FIG. 5 is a block diagram showing a main internal configuration of enhancement layer decoding section 105.

Encoded data demultiplexing section 111 uses as input the enhancement layer encoded data transmitted from the encoder (not shown) and demultiplexes the encoded data per codebook. The demultiplexed encoded data is outputted to enhancement layer gain decoding section 112, enhancement layer adaptive codebook decoding section 113, enhancement layer random codebook decoding section 114 and enhancement layer LPC decoding section 115.

Enhancement layer gain decoding section 112 decodes a "gain amount" given to pitch gain amplifying section 116 and code gain amplifying section 117. That is, enhancement layer gain decoding section 112 controls gains obtained by decoding encoded data based on enhancement layer loss information and narrowband spectral slope information. The obtained gain amount is outputted to pitch gain amplifying section 116 and code gain amplifying section 117, respectively. Further, when encode data cannot be received, lost data is interpolated using past decoded information and core layer decoded signal analyzing information.

Enhancement layer adaptive codebook decoding section 113 stores past enhancement layer excitation signals in the enhancement layer adaptive codebook, specifies a lag based on the encoded data transmitted from the encoder and clips a signal of a pitch period corresponding to this lag. An output signal is outputted to pitch gain amplifying section 116. Further, when encoded data cannot be received, lost data is interpolated using a past lag or information of a core layer.

Enhancement layer random codebook decoding section 114 generates a signal that cannot be represented by the above enhancement layer adaptive codebook, that is, a signal for representing noisy signal components which does not correspond to periodic component. This signal is algebraically represented in the codec of recent years. The output signal is outputted to code gain amplifying section 117. Further, when encoded data cannot be received, lost data is interpolated using past decoding information of the enhancement layer, core layer decoding information or random numbers.

Enhancement layer LPC decoding section 115 decodes encoded data transmitted from the encoder and outputs an obtained linear predictive coefficient for a filter coefficient of a synthesis filter, to enhancement layer synthesis filter 119. Further, when encoded data cannot be received, lost data is interpolated using encoded data received in the past or lost data is decoded further using LPC information of the core layer. At this time, when the analysis orders of linear prediction are different between the core layer and the enhancement layer, the order of an LPC of the core layer is extended and then the LPC is used for interpolation.

Pitch gain amplifying section 116 amplifies the output signal of enhancement layer adaptive codebook decoding section 113 by multiplying the signal by the pitch gain outputted from enhancement layer gain decoding section 112, and outputs the result to excitation adding section 118.

Code gain amplifying section 117 amplifies the output signal of enhancement layer random codebook decoding section 114 by multiplying the signal by the code gain outputted from enhancement layer gain decoding section 112, and outputs the result to excitation adding section 118.

Excitation adding section 118 generates an enhancement layer excitation signal by adding signals outputted from pitch gain amplifying section 116 and code gain amplifying section 117 and outputs the result to enhancement layer synthesis filter 119.

Enhancement layer synthesis filter 119 forms a synthesis filter using an LSP coefficient outputted from enhancement layer LPC decoding section 115 and obtains an enhancement layer decoded signal by operating the enhancement layer excitation signal outputted from excitation adding section 118 by receiving the signal as input. This enhancement layer decoded signal is outputted to decoded signal adding section 106. Further, post-filtering may be further performed on this enhancement layer decoded signal.

Figure 6:
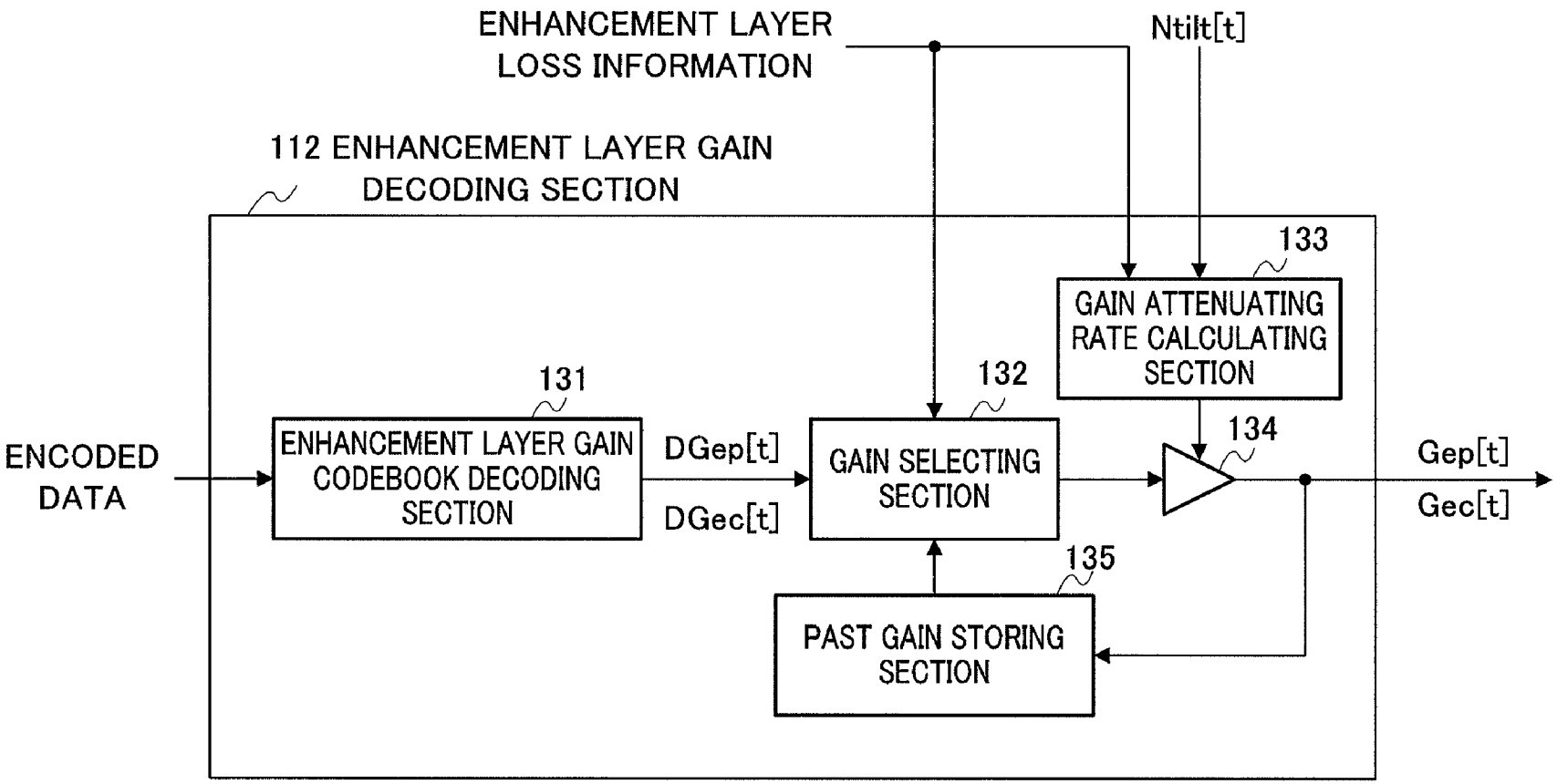
FIG. 6 is a block diagram showing a main internal configuration of an enhancement layer gain decoding section according to Embodiment 1.

FIG. 6 is a block diagram showing a main internal configuration of enhancement layer gain decoding section 112.

Enhancement layer gain decoding section 112 has enhancement layer gain codebook decoding section 131, gain selecting section 132, gain attenuating section 134, past gain storing section 135 and gain attenuating rate calculating section 133, and controls the interpolation gain of the enhancement layer using a past gain value of the enhancement layer and information of a narrowband spectral slope when data of the enhancement layer is lost. To be more specific, enhancement layer gain decoding section 112 receives encoded data, enhancement layer loss information and the narrowband spectral slope as input, and outputs two gains of pitch gain Gep[t] and code gain Gec[t].

Enhancement layer gain codebook decoding section 131 receives encoded data, decodes the encoded data and outputs obtained decoded gains DGep[t] and DGec[t] to gain selecting section 132.

Gain selecting section 132 receives as input the enhancement layer loss information, decoded gains (DGep[t] and DGec[t]) and past gains outputted from past gain storing section 135. Gain selecting section 132 selects whether to use the decoded gains or past gains based on the enhancement layer loss information and outputs the selected gain to gain attenuating section 134. To be more specific, gain selecting section 132 outputs the decoded gains when encoded data is received and outputs the past gains when data is lost.

Gain attenuating rate calculating section 133 calculates a gain attenuating rate based on the enhancement layer loss information and narrowband spectral slope information, and outputs the result to gain attenuating section 134.

Gain attenuating section 134 finds the gain after attenuation by multiplying the output from gain selecting section 132 by the gain attenuating rate calculated by gain attenuating rate calculating section 133, and outputs the result.

Past gain storing section 135 stores the gain attenuated by gain attenuating section 134 as the past gain. The stored past gain is outputted to gain selecting section 132.

Next, the gain control method according to this embodiment will be described in detail using equations.

Gain attenuating ratio calculating section 133 sets the gain attenuating rate lower when the narrowband spectral slope is moderate, so that the gain moderately attenuates. Further, gain attenuating rate calculating section 133 sets the gain attenuating rate higher when the narrowband spectral slope is steep, so that the gain substantially attenuates. The gain attenuating rate is calculated using following equation 4.

[4]

$$Gatt[t]=(\beta*Ntilt[t])*\alpha+(1-\alpha) \quad \text{(Equation 4)}$$

Here, Gatt[t] is the gain attenuating rate, β is the coefficient for correcting the slope and is a positive number larger than 0.0, and α is the coefficient for controlling the condition of the attenuating rate and takes values of $0.0<\alpha<1.0$. Coefficients of the pitch gain and the code gain may be changed.

Gain attenuating section 134 attenuates pitch gain Gep[t] and code gain Gec[t] according to equations 5 and 6.

[5]

$$Gep[t]=Gep[t-1]*Gatt[t] \quad \text{(Equation 5)}$$

[6]

$$Gec[t]=Gec[t-1]*Gatt[t] \quad \text{(Equation 6)}$$

Next, an enhancement layer excitation signal decoded by the scalable decoding apparatus according to this embodiment will be described with specific examples.

Figure 7:
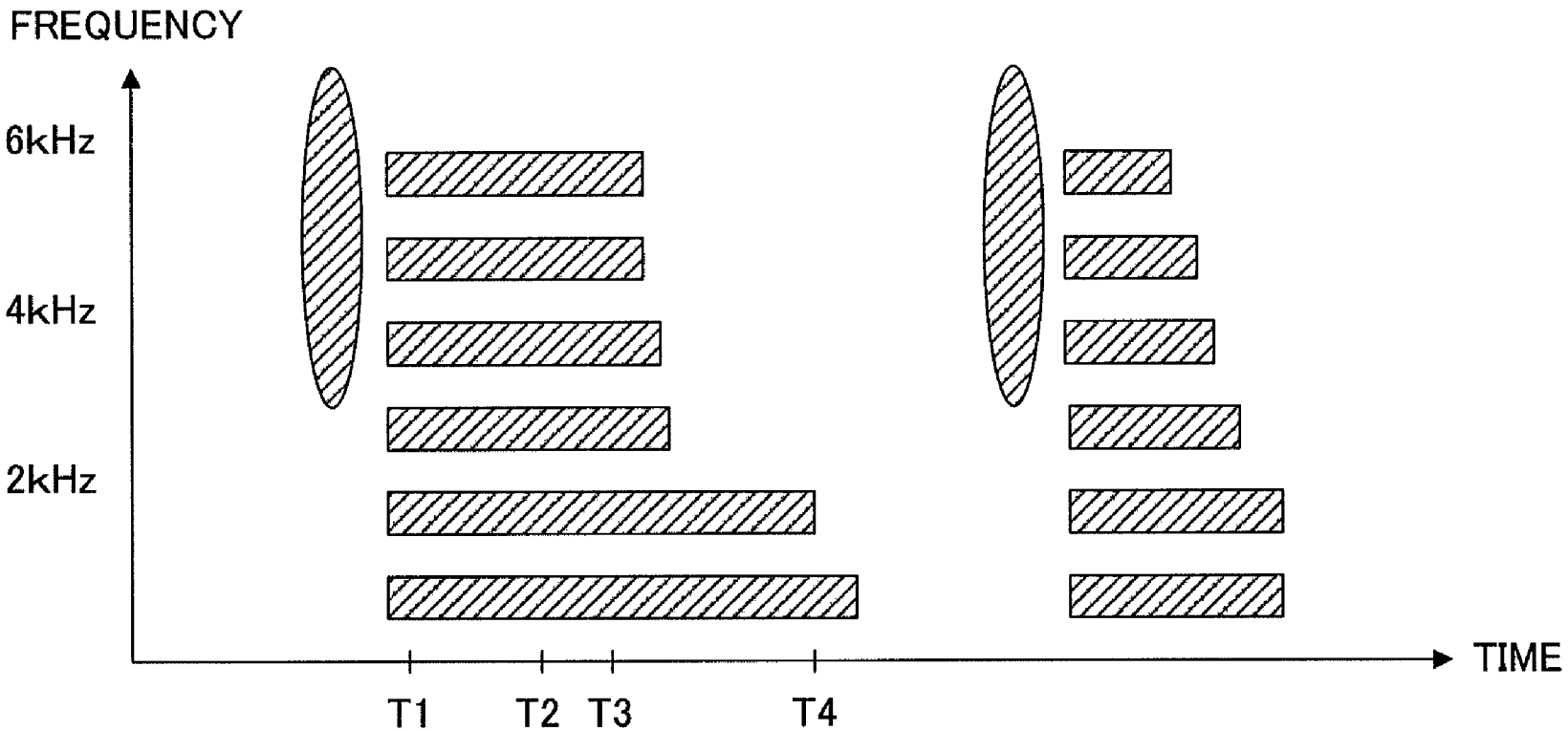
FIG. 7 is an image diagram illustrating concentration of the spectrum power.

FIG. 7 illustrates an example of concentration of the spectrum power of a speech signal. The horizontal axis is time and the vertical axis is the frequency. Power is concentrated in the bands shown by diagonal lines.

First, most consonant components at heads of speech are distributed in high bands of approximately 4 kHz or more. Then, vowel components continue around after T1 and are accompanied by the harmonic components in the high band, and there are the harmonics till T3.

Further, between T3 and T4, although, in the low frequency band of approximately 4 kHz or more, the harmonic components below approximately 2 kHz or less close to the fundamental frequency do not attenuate much, the harmonics in the intermediate band (near 3 kHz) or more attenuate steeply, and the harmonics cease to exist. Under the condition shown in this figure, the enhancement layer excitation power decreases steeply.

Figure 8:
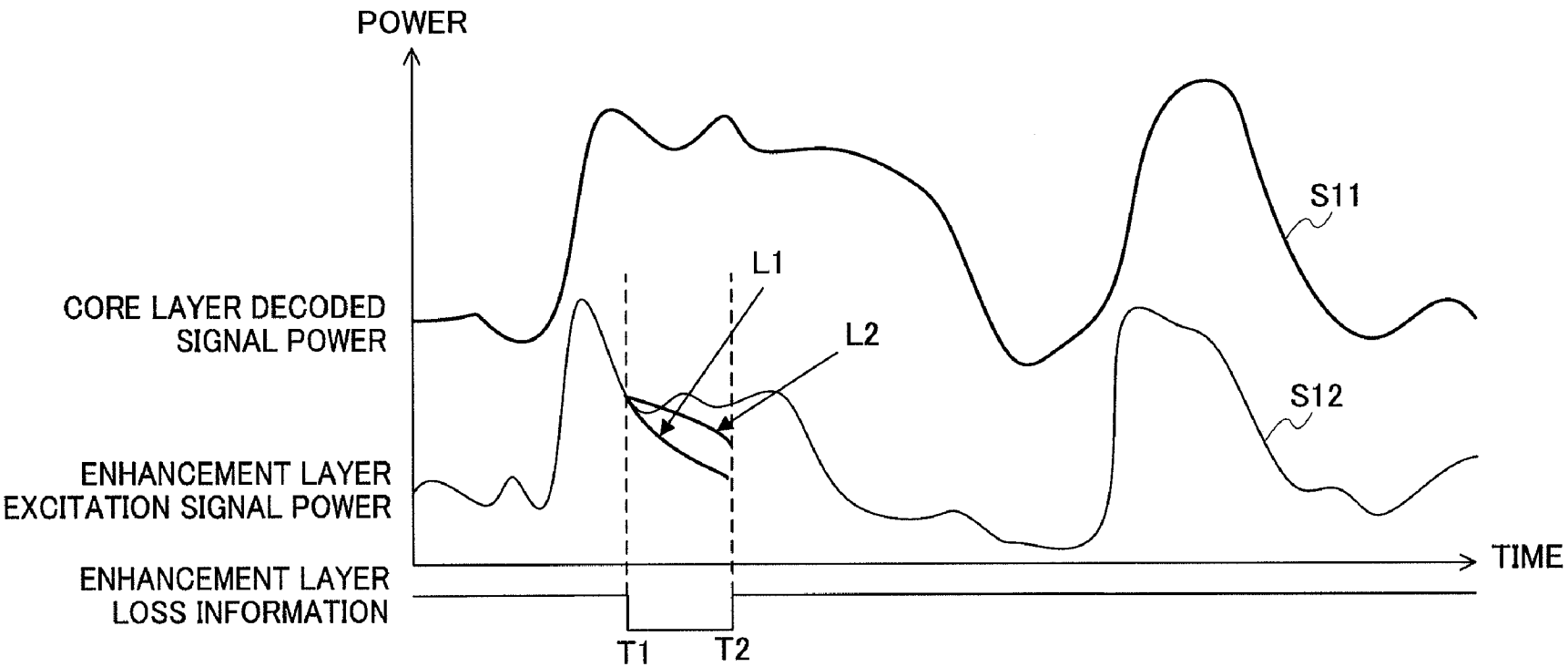
FIG. 8 shows power transition of a decoded excitation signal of an enhancement layer.
Figure 9:
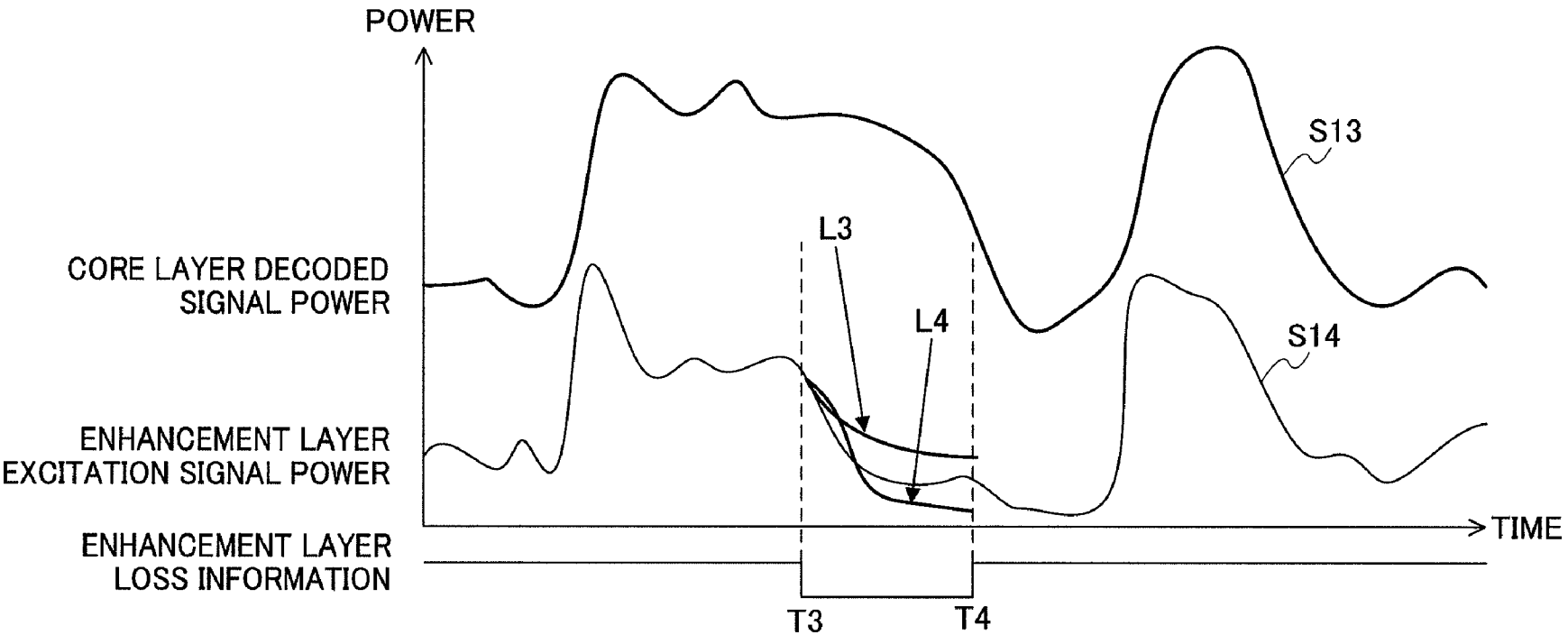
FIG. 9 shows power transition of the decoded excitation signal of the enhancement layer.

FIG. 8 and FIG. 9 show power transition of a decoded excitation signal of the enhancement layer when excitation interpolation processing is performed on the speech signal showing the spectrum power distribution of FIG. 7. The horizontal line is time and the vertical line is power, power S12 of the excitation signal of the enhancement layer and power S11 of the core layer decoded signal are shown. Further, S12 and S11 are power upon normal reception.

Furthermore, in these figures, enhancement layer loss information (receiving/non-receiving information) is shown together. In the example of FIG. 8, normal receiving state continues until T1, receiving disabled state (non-receiving state) continues due to data loss between T1 and T2 and normal receiving state continues after T2. In the example of FIG. 9, the normal receiving state continues until T3, the non-receiving state continues between T3 and T4 and the normal receiving state continues after T4.

The example of FIG. 8 shows that gain attenuating rate is set slow (corresponding to L2) by the scalable decoding apparatus according to this embodiment. In this example, the enhancement layer is lost in T1 and interpolating excitation is started in the enhancement layer. For example, a method of attenuating a gain at a fixed rate refers to setting one value (corresponding to L1) keeping the balance of two opposing demands of maintaining the band quality by moderate attenuation and avoiding annoying sound by steep attenuation.

Further, in the example of FIG. 8, there are the harmonics up to the high band and also in the intermediate band of a core layer and formants are highly likely to exist. In this case, the narrowband spectral slope becomes moderate and the scalable decoding apparatus according to this embodiment sets the lower attenuating coefficient for the enhancement layer gain (L2). As a result of this, excitation in the high band has greater correlation with a past or narrowband signal, it is easy to carry out extrapolation, and, consequently, it is possible to carry out natural interpolation.

The example of FIG. 9 shows that the attenuating rate of a gain is increased (corresponding to L4) by the scalable decoding apparatus according to this embodiment. In this example, the enhancement layer is lost in T3, and the interpolation of excitation is started in the enhancement layer. For example, similar to the example of FIG. 8, according to the method of attenuating a gain at a fixed rate, a gain can only be attenuated to a gain above the original excitation power level (S14) of the enhancement layer (L3), and therefore a signal in a band where originally there is no signal, is excessively emphasized and annoying sound is generated. On the other hand, the scalable decoding apparatus according to this embodiment sets a higher attenuating coefficient for the enhancement layer gain (L4). As a result, it is possible to attenuate a gain below the original excitation power level (S14) of the enhancement layer and realize more natural interpolation.

In the example of FIG. 9 (near T4), there are no harmonics in the high band of the intermediate band or less and signal power concentrate in the low band. In this case, with the scalable decoding apparatus according to this embodiment, the narrowband spectral slope is steep and so an attenuating rate of the enhancement layer interpolation gain is set higher. For this reason, it is possible to avoid excessively emphasizing the high band where originally there is no signal and avoid generating annoying sound.

In this way, according to this embodiment, natural interpolated speech is generated by adequately estimating the gain of interpolation data of the enhancement layer using the narrowband speech spectral slope when encoded data of the enhancement layer is lost. That is, based on the result of the narrowband spectral slope obtained by narrowband spectral slope calculating section 103 when the enhancement layer is lost, the attenuating rate of the interpolation gain of the enhancement layer is controlled according to the slope. To be more specific, when the narrowband spectrum moderately decreases toward the high band, the band quality is maintained by moderately attenuating the enhancement layer interpolation gain. On the other hand, when the narrowband spectrum substantially decreases toward the high band, a gain is prevented from being estimated greater, and annoying sound is prevented by steeply attenuating the enhancement layer interpolation gain.

To be more specific, the spectral slope of a narrowband signal is calculated from frequency information (envelope information) of narrowband speech which is a lower layer, the interpolation gain of the enhancement layer is suppressed when the slope is steep (that is, when power decrease toward the high band is great) and the interpolation gain of the enhancement layer moderately attenuates when the slope is moderate.

It is generally difficult to accurately estimate a signal of a higher band from a narrowband signal, and, when the period of enhancement layer loss becomes longer, an interpolated wideband signal becomes inaccurate and thereby results in deterioration of sound quality. For this reason, it is preferable to, when the period of enhancement layer loss becomes longer, attenuate and switch the enhancement layer interpolated signal to a narrowband signal which is an accurate decoded signal (for normal reception is carried out) even though the band quality is poor. Then, in this embodiment, frequency characteristics of speech, particularly voiced speech sound of vowel sounds, described below are used to estimate the gain of the enhancement layer in order to realize the above.

That is, a first feature is that there is correlation between the spectral distribution (to be more specific, the slope) of the core layer band (narrowband) and the spectral distribution of the band (wideband) up to the enhancement layer. In other words, when the slope moderately decreases toward the high band, the harmonics of the fundamental frequency are likely to exist even in the high band and therefore power of a signal is strong on the high band side. On the other hand, when the slope steeply decreases toward the high band, the harmonics are not likely to exist in the high band and therefore power of a signal becomes small on the high band side.

A second feature is that a signal in which the slope of the core layer band is moderate has correlation with a past signal. When there is voiced speech such as vowels, there are harmonics up to the high band and so the slope becomes moderate. Harmonics can be predicted from a signal of the narrowband, moderately change similar to a signal in the low band and have greater correlation with past signals. On the other hand, when the slope of the core layer band steeply decreases, harmonics are little likely to exist on the high band side, there are few signals on the high band side or there are signals of little correlation with past signals.

With the above features of speech, when the slope of the core layer band is moderate, power of the signal on the high band side moderately changes, has greater correlation with past signals, so that it is possible to obtain natural interpolated speech by moderately attenuating the enhancement layer gain. On the other hand, when the slope of the core layer band is steep, signals originally have no power on the high band side or signals have little correlation with past signals, so that it is possible to prevent annoying sound by steeply attenuating an enhancement layer gain.

That is, the scalable decoding apparatus according to this embodiment can maintain band quality of the enhancement layer decoded signal and prevent annoying sound by adequately estimating the enhancement layer gain. In this way, it is possible to reduce noise due to enhancement layer loss and maintain band quality.

Here, although a case has been described with this embodiment as an example where the attenuating rate of the enhancement layer gain is controlled according to the slope of the narrowband spectrum upon frame loss, the enhancement layer gain may be represented by the power of a core layer decoded signal or a relative value corresponding to the gain of the core layer and this relative value may be controlled according to a narrowband spectral slope.

Further, although a case has been described with this embodiment as an example where the processing unit for interpolation is made the processing unit for speech coding (frame), that is, interpolation is carried out on a per frame basis, a fixed time period such as a subframe shorter than the frame may be set as the processing unit for interpolation.

Furthermore, although a case has been described with this embodiment as an example where, when an arrow band spectral slope is calculated, spectral information obtained by decoding encoded data of a narrowband signal is used, a decoded signal obtained in the core layer may be used instead of spectrum information of a narrowband signal. That is, the frequency of this core layer decoded signal is converted using FFT (Fast Fourier Transform) and the narrowband spectral slope can be calculated based on frequency distribution. Moreover, when a linear predictive coefficient or corresponding frequency envelope information is transmitted, the frequency envelope information may be obtained from parameters and the narrowband spectral slope may be calculated using the frequency envelope information.

The embodiment of the present invention has been described so far.

The scalable decoding apparatus and lost data interpolation method according to the present invention is not limited to the above embodiment and can be realized by making various modifications.

The scalable decoding apparatus according to the present invention can be provided in a communication terminal apparatus and base station apparatus in a mobile communication system, so that it is possible to provide a communication terminal apparatus, base station apparatus and mobile communication system having same advantages and effects as described above.

Also, although cases have been described with the above embodiment as examples where the present invention is configured by hardware. However, the present invention can also be realized by software. For example, it is possible to implement the same functions as in the scalable decoding apparatus of the present invention by describing algorithms of the lost data interpolating method according to the present invention using the programming language, and executing this program with an information processing section by storing in memory.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC", "system LSI", "super LSI", or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese Patent Application No. 2005-189532, filed on Jun. 29, 2005, the entire content of which is expressly incorporated by reference herein.

INDUSTRIAL APPLICABILITY

The scalable decoding apparatus and lost data interpolation method can be applied for use in a communication terminal apparatus, base station apparatus and the like in a mobile communication system.

The invention claimed is:

1. A scalable speech decoding apparatus, comprising:

a narrowband speech decoder that decodes encoded speech data of a narrowband speech signal;

a wideband speech decoder that decodes encoded speech data of a wideband speech signal, and, when there is no encoded speech data of the wideband speech signal, generates alternative interpolation speech data;

a calculator that calculates a slope of an attenuation line of a spectrum of the narrowband speech signal in the frequency domain based on the encoded speech data of the narrowband speech signal; and a controller that controls a gain of the generated alternative interpolation speech data according to the calculated slope.

2. The scalable speech decoding apparatus according to claim 1, wherein the controller controls an attenuating rate of the gain according to the calculated slope.

3. The scalable speech decoding apparatus according to claim 1, wherein the controller increases an attenuating rate of the gain when the slope increases.

4. The scalable speech decoding apparatus according to claim 1, wherein the encoded speech data of the narrowband speech signal includes spectrum information of the narrowband speech signal.

5. The scalable speech decoding apparatus according to claim 1, wherein the calculator acquires the spectrum of the narrowband speech signal by decoding the encoded speech data of the narrowband speech signal and calculates the calculated slope of the attenuation from the spectrum.

6. A communication terminal apparatus comprising the scalable speech decoding apparatus according to claim 1.

7. A base station apparatus comprising the scalable speech decoding apparatus according to claim 1.

8. A lost speech data interpolation method comprising:

decoding encoded speech data of a narrowband speech signal;

decoding encoded speech data of a wideband speech signal;

generating alternative interpolation speech data when there is no encoded speech data of the wideband speech signal;

calculating a slope of an attenuation line of a spectrum of the narrowband speech signal in the frequency domain based on the encoded speech data of the narrowband speech signal; and controlling a gain of the generated alternative interpolation speech data according to the calculated slope.

9. The lost speech data interpolation method according to claim 8, wherein the encoded speech data of the narrowband speech signal includes spectrum information of the narrowband speech signal.

10. The lost speech data interpolation method according to claim 8, wherein the calculating acquires the spectrum of the narrowband speech signal by decoding the encoded speech data of the narrowband speech signal and calculates the calculated slope of the attenuation from the spectrum.

* * * * *